United States Patent [19]

Williston

[11] Patent Number: 4,523,930

[45] Date of Patent: Jun. 18, 1985

[54] METHOD OF MANUFACTURING COMPOSITE GRINDING WHEEL

[75] Inventor: William H. Williston, Holden, Mass.

[73] Assignee: Norton Company, Worcester, Mass.

[21] Appl. No.: 637,947

[22] Filed: Aug. 6, 1984

[51] Int. Cl.[3] ..... B24D 3/00

[52] U.S. Cl. ..... 51/293; 51/307

[58] Field of Search ..... 51/293, 307

[56] References Cited

U.S. PATENT DOCUMENTS

| | | | |
|---|---|---|---|
| 2,074,038 | 3/1937 | Willey | 51/280 |
| 2,189,259 | 2/1940 | Van Der Pyl | 51/278 |
| 2,766,565 | 10/1956 | Robison et al. | 51/206 |
| 3,220,810 | 11/1965 | Block | 51/293 |
| 3,756,796 | 9/1973 | Miller | 51/293 |
| 3,830,020 | 8/1974 | Gomi | 51/206 |

*Primary Examiner*—Paul Lieberman
*Assistant Examiner*—Willie Thompson
*Attorney, Agent, or Firm*—Rufus M. Franklin

[57] ABSTRACT

A composite grinding wheel comprising a support center with a peripheral groove containing a ring of metal bonded abrasive bonded thereto is made by placing in the bottom of an annular mold cavity, a ring whose internal bore is larger than and spaced from the inner smaller diameter of the mold cavity. The mold cavity above the ring is then filled with a sufficient volume of a mixture of metal bond and abrasive particles and closed off by an annular support center supported by the mold and having a central hub portion of smaller diameter than the internal bore in the ring and an axial height extending upwardly to an upper outer flange extending radially over the top of the mold cavity. The support center and ring are pressed together thereby compacting the mixture of metal bond and abrasive particles together between the upper outer flange and ring until the central hub extends into the ring and is substantially aligned with the bottom of the mold cavity and side of the ring. The cold pressed assembly is then heated sufficiently to sinter the metal bond, the abrasive particles, the support center, and ring, together into a unitary composite grinding wheel which is then stripped from the mold and, if necessary, machined to the desired size and shape.

6 Claims, 5 Drawing Figures

METHOD OF MANUFACTURING COMPOSITE GRINDING WHEEL

TECHNICAL FIELD

The invention is concerned with a new method for forming and bonding diamond grits on the periphery of a wheel having a steel center, and more particularly to a new method of producing a steel centered pencil edging or glass edge grinding wheel.

BACKGROUND ART AND INFORMATION DISCLOSURE STATEMENT

The following publications are representative of the most relevant prior art known to the applicant at the time of the filing of this application:

United States Patents

U.S. Pat. No. 2,074,038 F. H. Wiley, Mar. 16, 1937
U.S. Pat. No. 2,189,259 E. Van Der Pyl, Feb. 6, 1940
U.S. Pat. No. 2,766,565 H. E. Robison et al, Oct. 16, 1956
U.S. Pat. No. 3,830,020 S. Gomi, Aug. 20, 1974

The above listed patents show various ways of making diamond abrasive grinding wheels and include disclosures of the manufacture of the pencil edging type of wheels with which this invention is primarily concerned.

Van Der Pyl is an example of a wheel having a metal center with a rim of metal bonded diamond abrasive integral therewith. This patent is of general interest to show the pressing and sintering procedures conventionally used for shaping and bonding an abrasive ring that includes diamond grits to a driving center.

Robison et al and Gomi each disclose procedures for manufacturing pencil edging wheels including the use of pressure and sintering steps to complete the bonding of the diamond containing abrasive mix to the periphery of the driving center of the wheel.

Willey adds to all of the above a showing of the use of a specialized hot pressing procedure for bonding small diamond cutting elements in a tungsten carbide bond.

Pencil edging wheels have been made in the past by using various aspects of this known prior art diamond wheel technology and the present invention is concerned rather generally with the procedure described in the Robison et al patent making use of the outer periphery of the steel center annulus of the wheel as one element of the mold against which the ring containing the diamond abrasive mix is compacted in a cold pressing operation which is followed by a sintering step to complete the bonding of the abrasive containing ring to the driving annulus. In following the practice described in this patent as shown in FIG. 7 of that disclosure to complete the finishing steps for making the wheels, it is necessary to machine the side face of annulus 25 to remove excess metal down to the dot and dash line 55 and also machine off excess metal from flange 28 back to dot and dash line 56.

The present invention provides an improvement on this process for making a pencil edging wheel making it possible to manufacture such a wheel almost to finished dimensions thus minimizing the machine work formerly required to remove the unwanted excess. Further as practiced with a diamond abrasive mix making use of a copper tin bond composition as disclosed in Van Der Pyl it has heretofore been found to be useful when making pencil wheels as shown in Robison et al, to electro-plate at least the peripheral surface of the annulus and the ring 44 for containing the abrasive mix on the periphery of the wheel, in order to produce a better surface to complete the necessary welding of the mix to the ring as well as weld the ring to the annulus to prevent its working loose while grinding glass to the detriment of the wheel life such as sometimes occurs where the ring is not otherwise properly welded to the wheel annulus. The method of producing a pencil edging wheel as taught herein not only minimizes the larger proportions of the machine finishing steps that are required in Robison et al, but this invention makes it possible to eliminate the electro-plating operations heretofore required for preconditioning the wheel annulus and ring element for proper bonding together with each other and with the abrasive mix.

SUMMARY OF THE INVENTION

The improved wheel making method of this invention uses somewhat of a reversal of the molding procedure shown in Robison et al. Here the mold includes an inner arbor that is centrally disposed to frictionally support a cylindrical graphite guide mounted for sliding contact therewith. The mold comprises a spaced outer band concentrically supported on a common plane forming the bottom of the mold. Inside the band and concentrically arranged around the arbor are a bottom plate or ring and a split graphite mold ring that defines the outer periphery of, for example, a pencil edging wheel. The split elements of this graphite mold are supported on top of the bottom plate. Positioned on top of the bottom plate and within the mold ring is a steel ring that ultimately forms one of the flanges on the finished wheel. This ring has an outer diameter substantially equal to that of the finished wheel, its inner diameter is slightly larger than the outer diameter of the graphite guide supported on the central arbor. The space between the split graphite ring and the guide on the arbor is adapted to be filled with a diamond abrasive and copper-tin or copper-nickel or other suitable alloy that is compatible with the bond mix, as is well known, which diamond grit and bond mix may also contain tungsten carbide abrasive or other grits. After the diamond abrasive with its bond mixture has been filled into the cavity above the steel ring and between the graphite split ring and graphite guide, the steel drive annulus of the pencil edging wheel is slid into place over the top of the center arbor and is engaged by the top plate of the mold to be pressed downwardly. The wheel annulus has a shoulder portion around its periphery having a diameter just slightly smaller than the outer diameter of the graphite guide so that when the annulus is pressed downwardly the abrasive and bond mix flows easily onto the shoulder of the annulus. The wheel annulus has a ring integral therewith having an outer diameter the same as the diameter of the separate ring placed on the bottom plate so that when the full degree of cold pressure has been applied to the top plate of the mold, the compressed abrasive mix will fill the entire space between the loose ring and integral ring on the shoulder and a portion of the mix is compressed between the ring and the annulus. It should be noted that as the annulus is pressed downwardly the graphite guide slides down the arbor into a space that was intentionally provided between the ring shaped bottom plate that has been concentrically positioned relative to the arbor. When the steel center annulus of the wheel has been pressed fully downwardly, the first mentioned steel ring supported on the top of the bottom plate of the mold will surround the bottom end of the shoulder portion of the annulus so that this ring and the ring integral with the shoulder of the annulus together form oppositely disposed flanges on periphery of the wheel to support the sides of the abrasive mix compressed into the peripheral groove thus formed around the annulus of the pencil edging wheel. The cold pressed assembly is then subjected to the conventional firing procedure to sinter the abrasive mix and its bond to fix the abrasive ring in place. During the sintering operation the bonding metals in the abrasive mix in contact with the integral ring and shoulder, welds the now bonded abrasive mix to these surfaces of the wheel. Also the bonding alloy engages the surface of the loose ring exposed to the mix to weld that portion of the composite wheel permanently together and the bonding alloy in the mix will permanently weld the first mentioned ring to the shoulder over which it has, in effect, been pressed during the cold pressing step.

IN THE DRAWINGS

DETAILED DESCRIPTION

Figure 5:
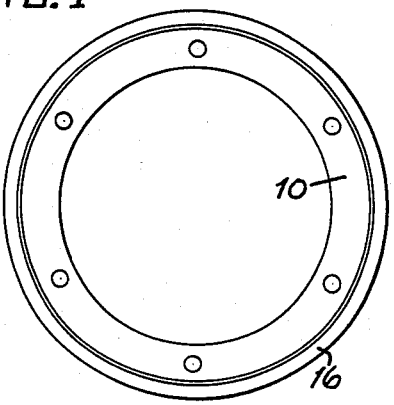
FIG. 5 is a bottom plan view of the wheel shown in FIG. 4.
Figure 4:
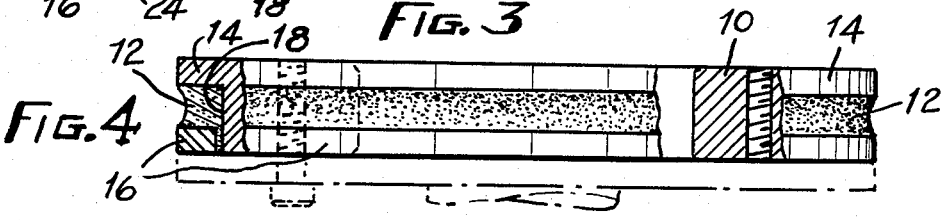
FIG. 4 is a vertical side view partly in section showing the finished pencil edging wheel mounted on a grinding machine spindle.

Referring first to FIG. 4 where a pencil edging wheel is shown that includes a steel driving annulus 10 that is suitably machined as also shown in FIG. 5, so that it may be mounted on a glass edge grinding machine. The annulus has a peripheral groove best seen in cross-section in which the abrasive mix 12 is bonded, the groove is defined by flange 14 formed integral with the annulus and a ring 16 that is welded to the annulus when the mix is sintered to bond the abrasive grits together and weld the bonded mix to the side walls and bottom of the groove 18 formed on a shoulder machined on the annulus.

Figure 1:
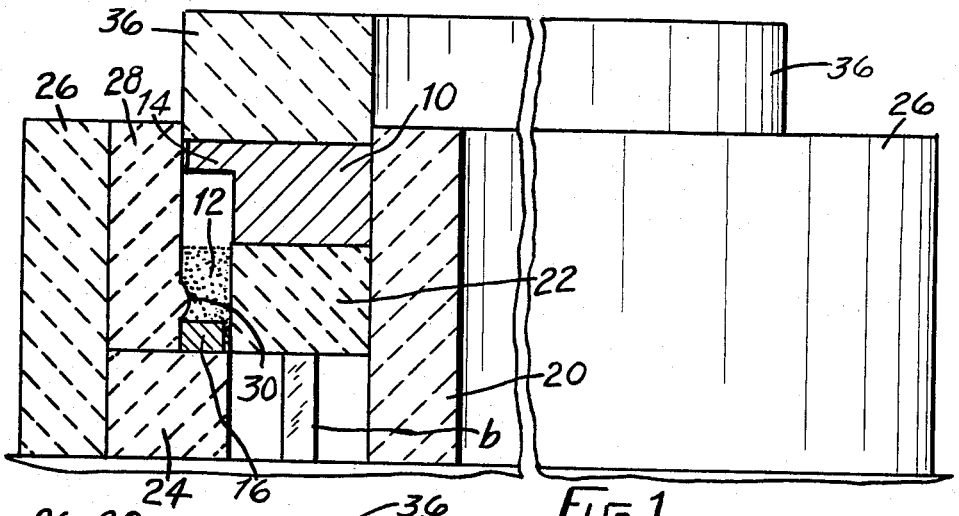
FIG. 1 is a vertical cross-section through the mold that is set up for a cold pressing step.

In order to make the wheel described above, a composite mold structure such as is shown in FIG. 1 is used. Essentially the mold is assembled around an arbor 20 that is adapted to be supported in vertical position. The arbor preferably has a cylindrical outer periphery over which a cooperating guide ring 22 is frictionally fitted. The guide ring is usually formed of graphite and is slidably mounted to move downwardly on arbor 20 with sufficient frictional contact between the arbor and ring such that the ring will remain in position against the pull of gravity but which can be moved easily when pushed with sufficient force. If necessary, removable spacer blocks (b) may be temporarily positioned as shown under the guide to hold it in place until the abrasive bond mix is filled into mold as will appear more fully below. The outer periphery of the guide has a dimension slightly greater than the diameter shoulder on the annulus that forms the bottom 18 of the groove on the periphery of the wheel in which the abrasive is contained.

Figure 2:
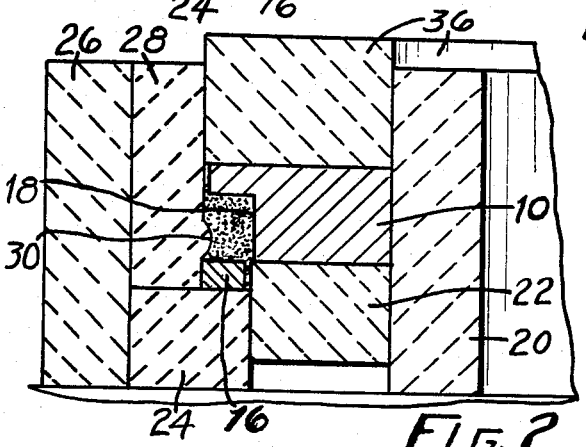
FIG. 2 shows the mold halfway through the cold pressing step.
Figure 3:
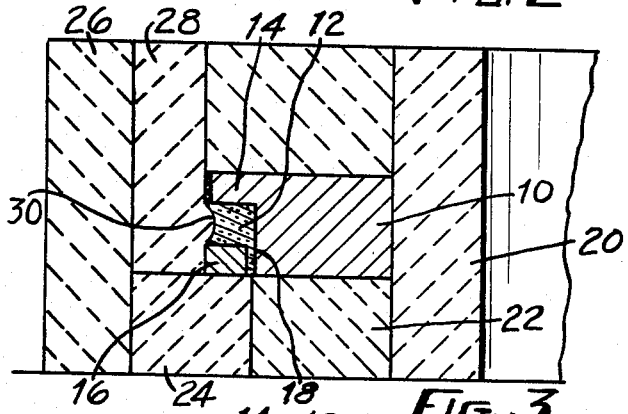
FIG. 3 shows the mold upon completion of the cold pressing and after a sintering operation.

Spaced concentrically around arbor 20 and below guide ring 22 is a doughnut-shaped bottom plate 24 that has a vertical height at least equal to the vertical height of guide ring 22. Usually this height is selected to be about equal to but may be greater than the height of the annulus 10 of the grinding wheel before it is subjected to its final finishing operations. It is seen in FIGS. 1, 2, and 3, that the guide ring is of a size to permit a thin layer of the abrasive bond mix to fill the space between the doughnut-shaped bottom plate and the guide when the mix is loaded into the mold.

The outer periphery of the bottom plate 24 is surrounded by a retaining band 26 that frictionally fits over the outer periphery of the bottom plate 24 to be assembled therewith. The bottom plate has a substantial horizontal width whereby the retaining band is spaced outwardly from the guide ring 22 a sufficient distance so that split ring mold elements, one of which 28, is shown in section in the drawings, can be fitted within the band to be supported on top of bottom plate 24 to form the periphery of the mold against which the periphery of the abrasive grain mix 12 can be pushed when the mix is cold pressed as will appear more fully below. For the purpose of molding the abrasive pencil edging abrasive surface, the bottom portion of each of the split ring elements has a rounded shoulder 30 integral therewith, all of the shoulders 30 of the several elements of the split ring being aligned to complete a uniform depression in the periphery of the abrasive portion of the wheel as is conventional in making pencil edging wheels.

Also supported on top of the bottom plate 24 is the ring 16 preferably formed of the same steel as annulus 10, the ring 16 being placed on bottom plate 24 as the split ring is being assembled around ring 16. The ring 16 ultimately becomes part of the finished wheel when it is welded to annulus 10 as will appear more fully below. Thus ring 16 has an outer diameter about equal to that of the finished wheel dimension and an inner diameter to permit the bottom 18 of the groove for holding the abrasive ring 12 to easily slide downwardly into the center of ring 16 as the assembly of the annulus and these parts progresses.

When the ring 16 has been placed on bottom plate 24 and all of the split ring elements 28 have been properly placed within the mold band 26, the space defined by the inner surfaces of the split ring elements, the top of ring 16 and the outer face of the guide ring 22 on the arbor is adapted to be filled with the unbonded abrasive mix that ultimately is compressed and welded to the periphery of annulus 10. A portion of this mix is filled into the space between the guide ring 22 and the inner periphery of ring 16. The abrasive mix is filled into this space and levelled off to preferably have the upper surface of the filled mix fall just below the rim of the upper surface of the guide ring 22.

To complete the wheel structure, annulus 10 is now fitted over arbor 20 to slide downwardly against the top of guide ring 22. It will be noted that the shoulder on the annulus that forms the bottom 18 of the groove around the periphery of the annulus, is concentric with or just slightly smaller in diameter than the outer diameter of guide ring 22. On top of the annulus, the top plate 36 of the mold is laid. The top plate is an annular element having an inner diameter to slidably fit neatly within the inner periphery of the assembled split ring elements 28 and the periphery of arbor 20. The top plate has a vertical height consistent with the dimensions of the other elements of the composite mold structure to control the movement of annulus 10 downwardly on the arbor when the mold is subjected to a cold pressing step.

When a loose abrasive bond mix has been filled into the space provided and leveled off near the top of the guide ring 22, and the annulus 10 and top plate are in place, pressure may be applied to the top plate as is well known in the art, and the annulus is driven downwardly to compact the still unbonded abrasive mix. The annulus 10 forces guide ring 22 downwardly into the space in the hole of the doughnut-shaped bottom plate 24 while the shoulder and bottom of groove 18 moves in behind the unbonded abrasive mix. If spacers b have been used to temporarily hold the guide ring 22 in position until the filling and final mold assembly steps have been completed, the spacers must, of course, be removed prior to the cold pressing operation. As the annulus is forced further downwardly flange 14 integral with the annulus engages the mix as shown in FIG. 2 and ultimately the mix is compacted to the size shown in FIG. 3. It will be noted that the unbonded but now compacted mix fills the groove defined by flange 14, or bottom of groove 18, and ring 16, with a very small portion of the mix being compacted between the bottom 18 and the inner periphery of ring 16. At this point the top plate 36 will have been pushed substantially flush with the top of mold, guide ring 22 will be pushed down entirely into the space between the arbor 20 and the inner periphery of bottom plate 24, so that bottom surface of ring 16 is flush with the bottom wall of the annulus 10. When the cold pressing step has been completed, the mold assembly is subjected to a heating or firing step to sinter the copper-tin bond or other alloy included in the mix. This dispersion of a portion of the mix between the bottom or shoulder 18 and ring 16 perfects a proper weld even though no electroplated coating has been used as heretofore practiced, to complete the sinter bonding and more perfect welding together of all of the several parts of the wheel structure.

After cooling in the mold, the pencil edging wheel may be stripped from the mold and finished. Since the wheel has been molded almost to size, very little trueing is needed to finish the outer periphery of the wheel. It will be found that the annulus 10 suffers very little, if any, distortion during the sintering step and when its sides are precision finished, very little metal need be removed to complete the final machining steps required for producing production pencil edging wheels.

In production as above described, to ensure the proper positioning of guide ring 22 on arbor 20, it may be desirable to place several spacers b under the ring in the hole of the doughnut shaped bottom plate 24. When the cold pressing step is about to be performed these spacers may be removed and the mold operates as above described.

The mold structure itself provides a combination well adapted for the production of pencil edging wheels and the method of forming the wheel by welding ring 16 to annulus 10 to form flange 16, eliminates the steps heretofore deemed necessary, of electroplating the periphery of the annulus 10 and ring 16 prior to assembly of these parts to aid the welding of the ring to the annulus during the sintering step.

The specification above includes a description of the preferred construction of the molding apparatus and method of using it for the making of pencil edging wheels in accordance with this invention. It is possible that modifications thereof may occur to those skilled in the art that will fall within the scope of the following claims.

What is claimed:

1. The method of making a composite grinding wheel having an annulus forming a support member, the annulus having a groove surrounding its periphery, said groove being defined by side walls and having an inner and outer periphery and being adapted to receive and be bonded to the grinding medium, said annulus including a shoulder around its periphery for defining a floor and one wall of said groove, and said composite wheel including a ring element adapted to be assembled over said shoulder and bonded to said annulus to complete said composite wheel comprising the steps of: supporting said annulus and said ring in spaced apart but concentric relationship; fitting a plurality of mold components together with said spaced apart annulus and ring elements to form a mold cavity that defines the outer periphery of said groove and is concentric with said inner periphery; filling said cavity with unbonded grinding medium; cold pressing said annulus and ring together and compacting said grinding medium while moving said shoulder and said ring elements into a concentric juxtaposed position; and sinter bonding said cold pressed grinding medium; and then stripping said mold components from the assembled bonded grinding medium, shoulder, and ring element that has been bonded to said shoulder.

2. A method as in claim 1 wherein said mold components include concentrically spaced apart graphite ring members.

3. A method as in claim 2 wherein one of said graphite rings is displaced by said shoulder element of said annulus during performance of said cold pressing step.

4. A method as in claim 1 wherein split ring graphite mold components are used to define said outer periphery of said circular mold.

5. A method as in claim 4 wherein said graphite components that define said outer periphery are shaped to produce a groove around the perimeter of said assembled abrasive wheel.

6. A method as in claim 1 wherein said glass grinding medium includes a mixture of abrasive particles distributed throughout particles of a metal bond, and said bonding is completed while hot pressing said medium and said shoulder and ring elements together.

* * * * *